US007382320B2

(12) United States Patent
Chang et al.

(10) Patent No.: US 7,382,320 B2
(45) Date of Patent: Jun. 3, 2008

(54) CIRCULARLY POLARIZED ANTENNA

(75) Inventors: The-Nan Chang, Taipei (TW); Chun-Ming Lin, Taipei (TW)

(73) Assignee: Tatung Company and Tatung University, Taipei (TW)

( * ) Notice: Subject to any disclaimer, the term of this patent is extended or adjusted under 35 U.S.C. 154(b) by 2 days.

(21) Appl. No.: 11/493,017

(22) Filed: Jul. 24, 2006

(65) Prior Publication Data

US 2007/0257844 A1 Nov. 8, 2007

(30) Foreign Application Priority Data

May 4, 2006 (TW) ..... 95115866 A

(51) Int. Cl.
*H01Q 1/38* (2006.01)

(52) U.S. Cl. ..... 343/700 MS; 343/770; 343/732

(58) Field of Classification Search ..... 343/700 MS, 343/770
See application file for complete search history.

(56) References Cited

U.S. PATENT DOCUMENTS

| | | | | |
|---|---|---|---|---|
| 4,053,895 | A | 10/1977 | Malagisi | 343/700 MS |
| 4,684,952 | A | 8/1987 | Munson et al. | 343/700 MS |
| 4,697,189 | A * | 9/1987 | Ness | 343/700 MS |
| 6,091,365 | A | 7/2000 | Derneryd et al. | 343/700 MS |
| 6,195,047 | B1 | 2/2001 | Richards | 343/700 MS |
| 6,288,679 | B1 * | 9/2001 | Fischer et al. | 343/700 MS |
| 6,509,883 | B1 * | 1/2003 | Foti et al. | 343/850 |
| 7,006,044 | B2 * | 2/2006 | Choi et al. | 343/700 MS |
| 2003/0137464 | A1 * | 7/2003 | Foti et al. | 343/770 |
| 2004/0145524 | A1 * | 7/2004 | Bae | 343/700 MS |
| 2007/0296634 | A1 * | 12/2007 | Popugaev et al. | 343/700 MS |

FOREIGN PATENT DOCUMENTS

| | | |
|---|---|---|
| JP | P 3006867 | 11/1999 |
| JP | P2001-512640 A | 8/2001 |

* cited by examiner

*Primary Examiner*—Trinh Vo Dinh
(74) *Attorney, Agent, or Firm*—Bacon & Thomas, PLLC

(57) ABSTRACT

The present invention relates to a circularly polarized antenna and, more particularly, to a compact circularly polarized antenna for transmitting and receiving a circularly polarized signal. The circularly polarized antenna comprises a substrate having an upper surface and a lower surface; a signal distributor; an antenna for transmitting and receiving the circularly polarized signal; and a plurality of support units. The upper surface of the substrate comprises a plurality of slots. One end of each slot overlaps with the respective ends of the other slots at a central region. The lower surface of the substrate comprises a coupling unit being electrically connected with the signal distributor, and the center of the coupling unit corresponds to the central region.

19 Claims, 9 Drawing Sheets

CIRCULARLY POLARIZED ANTENNA

BACKGROUND OF THE INVENTION

1. Field of the Invention

The present invention relates to a circularly polarized antenna and, more particularly, to a small-sized circularly polarized antenna for transmitting and receiving a circularly polarized signal.

2. Description of Related Art

In some electrical devices, such as the reader device of an RFID system, the antenna module of which must be able to transmit and receive a circularly polarized signal, in order to ensure that the electrical devices can operate normally in any kind of attitude. Besides, since the antenna module must be small enough to be portable, the size of the antenna module of the electrical device is also limited.

Generally, the circularly polarized antenna of the prior art uses a straight coupling line to couple the electrical signal to the antenna unit, in order to transform the electrical signal into a circularly polarized signal. Then, the circularly polarized signal is transmitted outside. Thus, the substrate of the circularly polarized antenna of the prior art must have a size large enough to enclose the straight coupling line on the surface thereof. Moreover, since the length of the side of the antenna unit must be about half of the wavelength of the circularly polarized signal being transmitted, so if the frequency of the circularly polarized signal being transmitted is 915 MHz, the length of the antenna unit should be 164 mm in the free space.

The methods to reduce the length of the side of the antenna unit are (1) forming some slots on the surface of the antenna unit or (2) changing the shape of the antenna unit, in order to increase current path. But, both the aforementioned methods are too complex. As a result, the structure of the circularly polarized antenna of the prior art is too complex to reach the requirement of easy-design.

Therefore, it is desirable for the industries to provide a circularly polarized antenna with a small size, which can not only have the simple structure (the standard shape of square and circle), but also have same function to apply in any kind of the antenna module of the portable electrical device.

SUMMARY OF THE INVENTION

The circularly polarized antenna for transmitting and receiving a circularly polarized signal of the present invention comprises a substrate having an upper surface and a lower surface; a signal distributor; an antenna for transmitting and receiving the circularly polarized signal; and a plurality of support units for supporting the antenna and maintaining a predetermined distance between the antenna and the upper surface of the substrate. The upper surface of the substrate comprises a plurality of slots, wherein one end of each slot overlaps with the respective ends of the other slots at a central region. The lower surface of the substrate comprises a coupling unit being electrically connected with the signal distributor, and the center of the coupling unit corresponds to the central region.

Therefore, in the same range of the operating frequency (i.e. the operating frequency of the RFID ranges from 902 MHz to 928 MHz), the circularly polarized antenna of the present invention can reduce the size of the antenna and the substrate by forming some slots on the upper surface of the substrate and by changing the size of the coupling portion, so as to maintain the same operating ability as the circularly polarized antenna of the prior art (i.e. having the same return loss and the operating frequency bandwidth). Therefore, the circularly polarized antenna of the present invention can be compact and keep the shape of antenna simple, so as to facilitate the development of a small-sized, more convenient and portable electrical device having the circularly polarized antenna of the present invention, such as the reader device of an RFID system.

The coupling unit of the circularly polarized antenna of the present invention can comprise any kind of coupling portion, but preferably the coupling portion is a coupling-ring portion with an opening or a polygon-shaped ring having fewer than thirty-six sides with an opening. The substrate of the circularly polarized antenna of the present invention can be made as any suitable printed circuit board, but preferably the printed circuit board is an FR-4 microwave substrate, a Duroid™ microwave substrate, or a Teflon™ microwave substrate. The signal distributor of the circularly polarized antenna of the present invention can use any kind of signal distributor, but preferably it is a coaxial cable connector. The signal distributor of the circularly polarized antenna of the present invention can be electrically connected with any kind of signal transmitting line, but preferably the signal transmitting line is a coaxial cable, or a copper strand wire. The upper surface of the substrate of the circularly polarized antenna of the present invention can have formed therein any quantity of the slots, but preferably the quantity of the slots ranges from 4 to 36. Besides, each slot formed on the upper surface of the substrate of the circularly polarized antenna of the present invention preferably has the same width. The size of the coupling portion of the lower surface of the substrate of the circularly polarized antenna of the present invention is not restricted, but preferably the width of the coupling portion is equal to the width of each slot. The shape of the end of each slot is preferably dumbbell-shaped or having a lateral pool. The antenna of the circularly polarized antenna of the present invention can be composed of any kind of metals, but preferably the antenna is composed of a copper alloy containing more than ninety-eight percent copper. The substrate of the circularly polarized antenna of the present can be formed in any kind of shape, but preferably the substrate is a square plate, a rectangular plate or a circular plate. The antenna of the circularly polarized antenna of the present invention preferably is a square plate, a rectangular plate, a square plate with chamfered corners, a rectangular plate with chamfered corners, a polygon-shaped plate, or a circular plate. The supporting unit of the circularly polarized antenna of the present invention preferably is composed of plastics or any electrically insulating materials. The circularly polarized signal of the present invention can transmit or receive circularly polarized signals in any frequency range, but preferably, the frequency ranges from 900 MHz to 930 MHz or from 400 MHz to 600 MHz. The length of the side-length of the antenna of the circularly polarized antenna of the present invention is not restricted, but preferably, the side-length of the antenna ranges from the one-quarter to three-quarters of the wavelength of the circularly polarized signal being transmitted or received by the circularly polarized antenna of the present invention.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
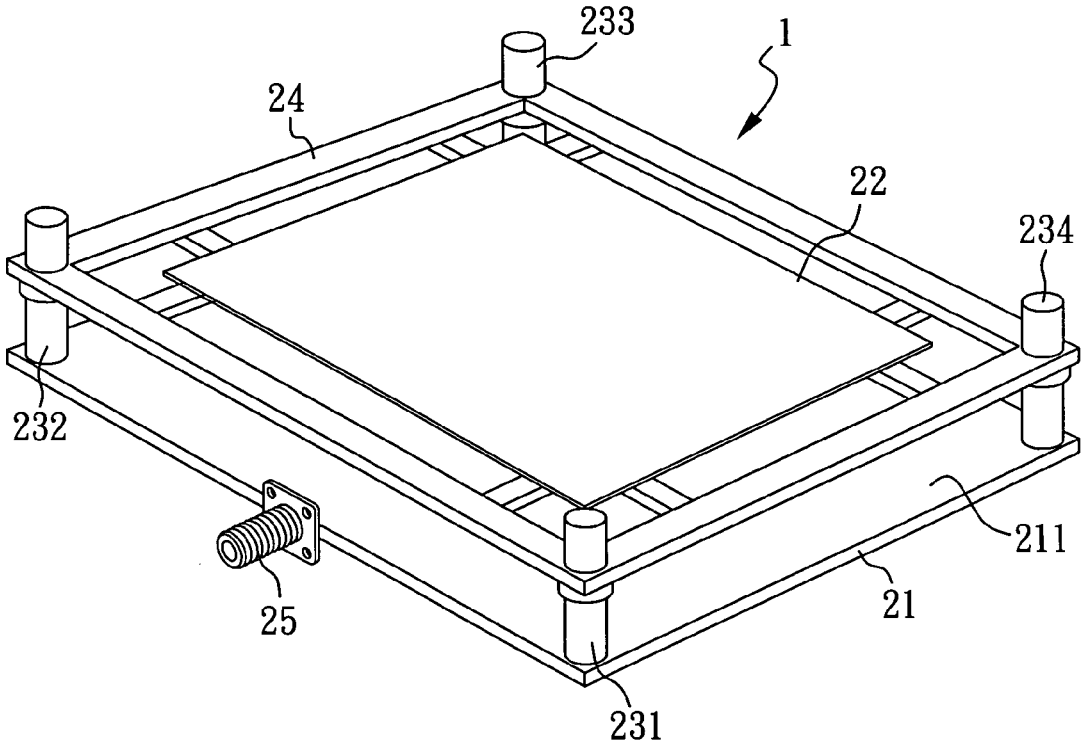
FIG. 1 is a schematic drawing of the circularly polarized antenna according to the first preferred embodiment of the present invention.

FIG. 1 is a schematic diagram of the circularly polarized antenna according to the first preferred embodiment of the present invention. The substrate 21 is an FR-4 microwave substrate with the thickness of 0.8 mm, and the antenna 22 is composed of a copper alloy containing more than ninety-eight percent copper. Referring to FIG. 1, the antenna 21 connects with the supporting structure 24 supported by a first supporting rod 231, a second supporting rod 232, a third supporting 233, and a fourth supporting rod 234. Therefore, the antenna 22 maintains a predetermined distance between it and the upper surface 211 of the substrate 21. By adjusting the predetermined distance, the gain of the circularly polarized antenna of the present invention can be raised and the circularly polarized characteristics of the circularly polarized antenna can also be improved.

Since the predetermined distance between the antenna 22 and the upper surface 211 of the substrate 21 is essential for designing the operating frequency of the circularly polarized antenna 1, when the operating frequency of the circularly polarized antenna 1 needs to be changed, the first supporting rod 231, the second supporting rod 232, the third supporting 233, and the fourth supporting rod 234 must be adjusted to change the predetermined distance between the antenna 22 and the upper surface 211 of the substrate 21.

Figure 2A:
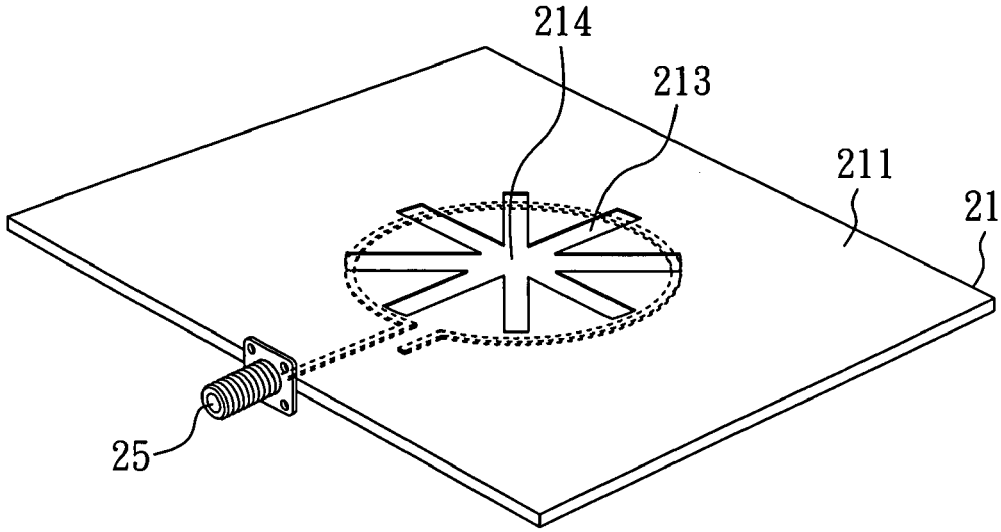
FIG. 2A is a schematic drawing of the substrate of the circularly polarized antenna according to the first preferred embodiment of the present invention.
Figure 2B:
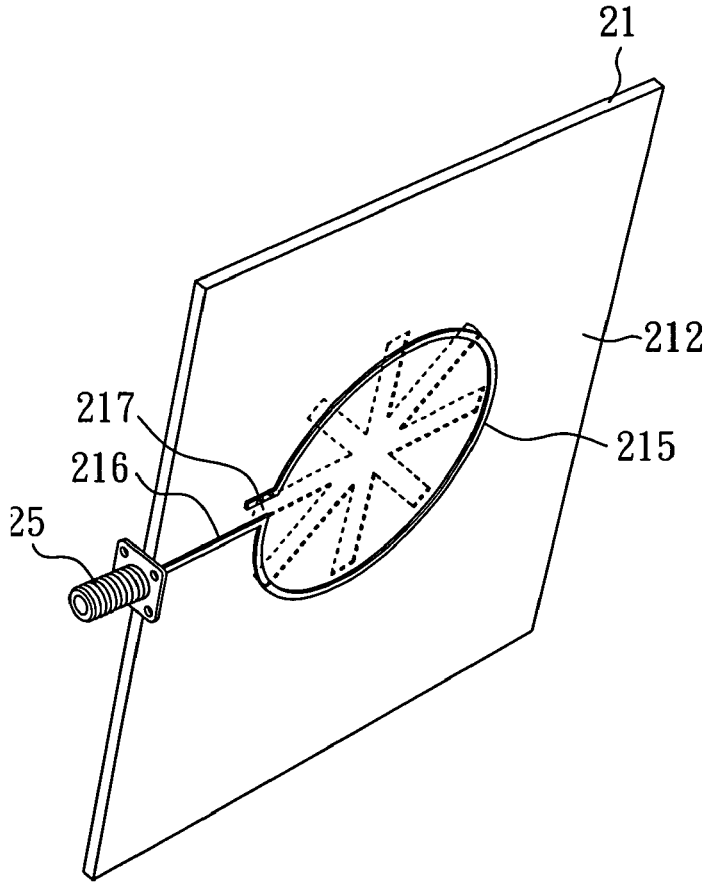
FIG. 2B is a schematic drawing of the substrate of the circularly polarized antenna according to the first preferred embodiment of the present invention.

FIG. 2A is a schematic diagram of the upper surface 211 of substrate 21 of the circularly polarized antenna according to the first preferred embodiment of the present invention. FIG. 2B is a schematic diagram of the lower surface 212 of substrate 21 of the circularly polarized antenna according to the first preferred embodiment of the present invention. Referring to FIG. 2A, the upper surface 211 of the substrate 21 comprises eight slots 213, and one end of each slot 213 overlaps with the respective ends of the other slots at a central region 214. In addition, referring to FIG. 2B, the lower surface 212 of the substrate 21 comprises a coupling-ring line 215 and a straight coupling line 216, wherein the coupling-ring line 215 has an opening 217 on the edge. That is, the coupling-ring line 215 is not completely closed. In addition, the center of the coupling-ring line 215 corresponds to the center region 214 of the upper surface 211 of the substrate 21, and the coupling-ring line 215 is electrically connected with a coaxial cable connector 25 through the straight coupling line 216.

Moreover, the frequency range of the circularly polarized signal being transmitted and received (i.e. the resonant frequency) by the circularly polarized antenna 1 can be controller by adjusting the diameter of the coupling-ring line 215, while the shape of the antenna 21 still remains simple.

Figure 3:
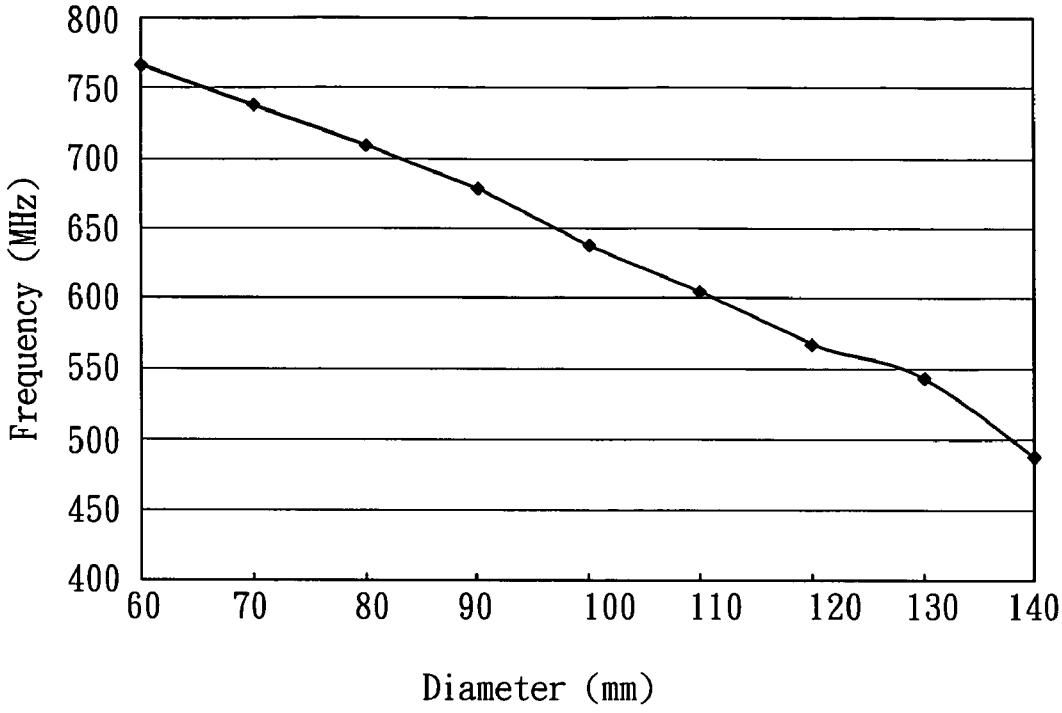
FIG. 3 is a schematic drawing showing the relation between the diameter of the coupling-ring and resonant frequency of the circularly polarized antenna according to the first preferred embodiment of the present invention.

Referring to FIG. 3, when the size of the antenna size of the present invention is equal to that of the prior art circularly polarized antenna. That is, the diameter of the coupling-ring line is about 138 mm, the resonant frequency of the circularly polarized antenna according to the first preferred embodiment of the present invention is about 500 MHz, which is suitable for the application of digital television. Besides, this resonance frequency is obviously lower than that of the circularly polarized antenna of the prior art (about 915 MHZ). Therefore, when the diameter of the coupling-ring line of the antenna of the present invention becomes shorter, the resonant frequency of the circularly polarized antenna will become larger, toward the high-frequency range. For this reason, the circularly polarized antenna of the present invention can use a substrate with smaller size to have the same resonant frequency range as the circularly polarized antenna of the prior art.

In the present embodiment, the circularly polarized antenna of the present invention only uses the substrate (FR-4 microwave substrate) with a dimension of 130 mm×130 mm and the antenna (copper plate) with a dimension of 108 mm×108 mm to transmit and receive the circularly polarized signal, the frequency of which ranges from 902 MHz to 928 MHz. Obviously, the size of the antenna of the circularly polarized antenna of the present invention is smaller than that of the antenna of the circularly polarized antenna of the prior art (i.e., 164 mm×164 mm). Furthermore, the resonant distance between the substrate and the antenna of the circularly polarized antenna of the present invention is only 11.4 mm.

Referring to FIG. 2A, the upper surface of the substrate 21 of the circularly polarized antenna of the present invention comprises eight slots 213, and one end of each slot overlaps with the respective ends of the other slots at a central region 214. The width of each slot is 4 mm. In another aspect, referring to FIG. 2B, the coupling-ring line 215 is electrically connected with the coaxial cable connector 25 through the straight coupling line 216, wherein the width of the coupling-ring line 215 and the width of the straight coupling line 216 are both 4 mm, and the diameter of the coupling-ring line is 72 mm.

Therefore, when the circularly polarized antenna of the present invention is in its "transmitting state", the coaxial cable connector 25 receives an electrical signal from a coaxial cable (not shown), so as to transmit the electrical signal to the coupling-ring line 215 with an opening via the straight coupling line 216. Then, the coupling-ring line 215 and the slots 213 on the upper surface 211 of the substrate 21 transform the electrical signal into a circularly polarized signal and then transmit it outside. In addition, while the circularly polarized antenna of the present invention is in its "receiving state", the coupling-ring line 215 and the slots 213 on the upper surface 211 of the substrate 21 receive a circularly polarized signal and transform the circularly polarized signal into an electrical signal, Then, the electric signal is transmitted to a coaxial cable (not shown) via the straight coupling line 216 and the coaxial cable connector 25 for further signal processing processes.

Figure 4A:
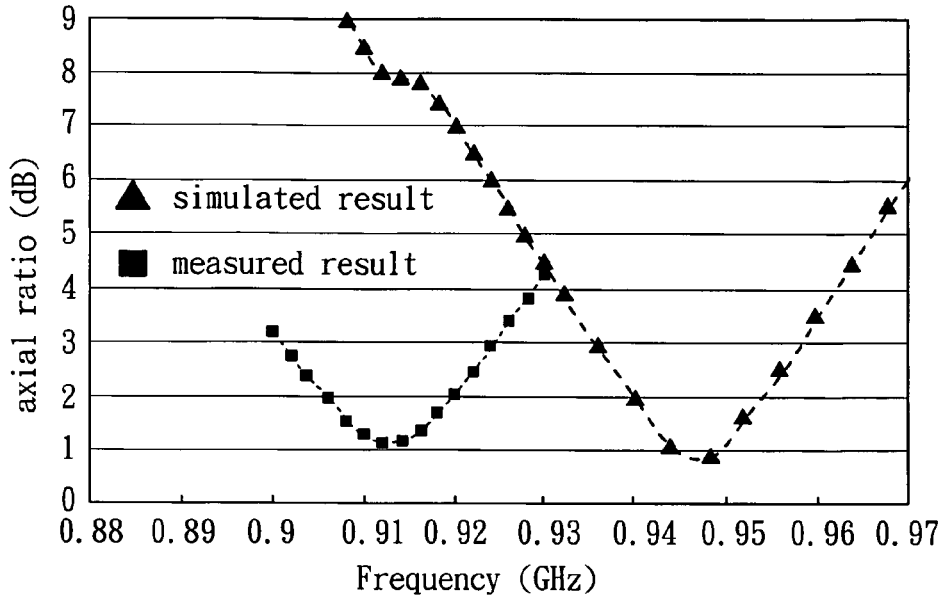
FIG. 4A shows the simulated result and the measured result of the axial ratio of the circularly polarized signal transmitted by the circularly polarized antenna according to the first preferred embodiment of the present invention.

FIG. 4A shows the simulated result and the measured result of the axial ratio of the circularly polarized signal transmitted by the circularly polarized antenna according to the first preferred embodiment of the present invention, wherein the simulated result and the measured result are represented by triangular dots and square dots, respectively. Referring to FIG. 4A, the measured result of the center frequency of the circularly polarized signal (about 0.91 GHz) is slightly smaller than the simulated result of the center frequency of the circularly polarized signal (about 0.95 GHz). Besides, the impedance bandwidth (the −10 dB bandwidth) of the circularly polarized antenna according to the first preferred embodiment of the present invention is about 126 MHz, while the 3 dB axial ratio thereof is about 2.5%.

Figure 4B:
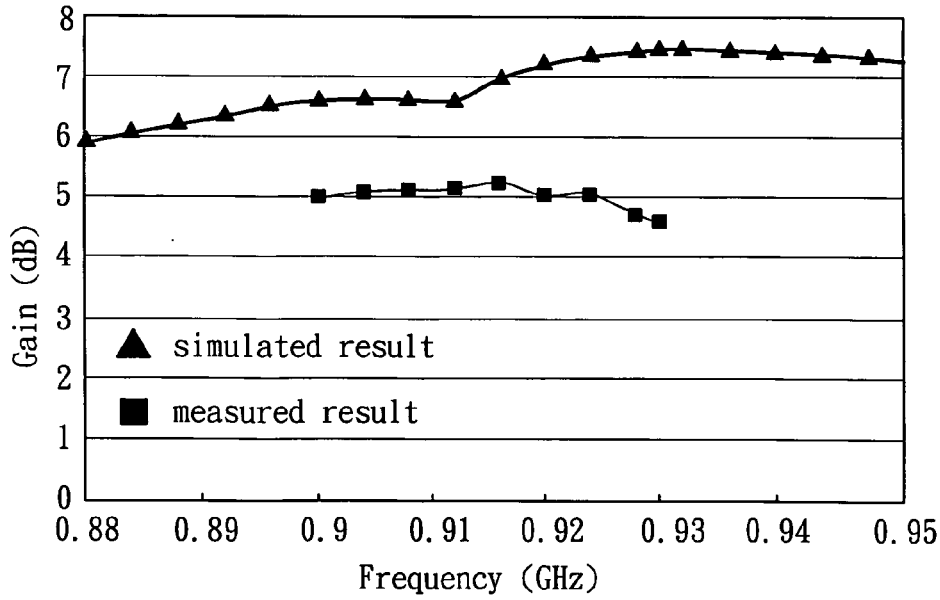
FIG. 4B shows the simulated result and the measured result of the gain of the circularly polarized antenna according to the first preferred embodiment of the present invention.

FIG. 4B shows the simulated result and measured result of the gain of the circularly polarized antenna according to the first preferred embodiment of the present invention, wherein the simulated result and the measured result are represented by triangular dots and square dots, respectively. Referring to FIG. 4B, the simulated result of the gain of the circularly polarized antenna according to the first preferred embodiment of the present invention is bigger than the measured result of the gain of the circularly polarized antenna according to the first preferred embodiment of the present invention, since the simulated result is based on an assumption that the substrate is a substrate without any return loss.

In addition, the substrate of the circularly polarized antenna of the present invention can have any quantity of the slots on the upper surface thereof, i.e., the quantity can be 12, 16, 36, and even 64.

Figure 5A:
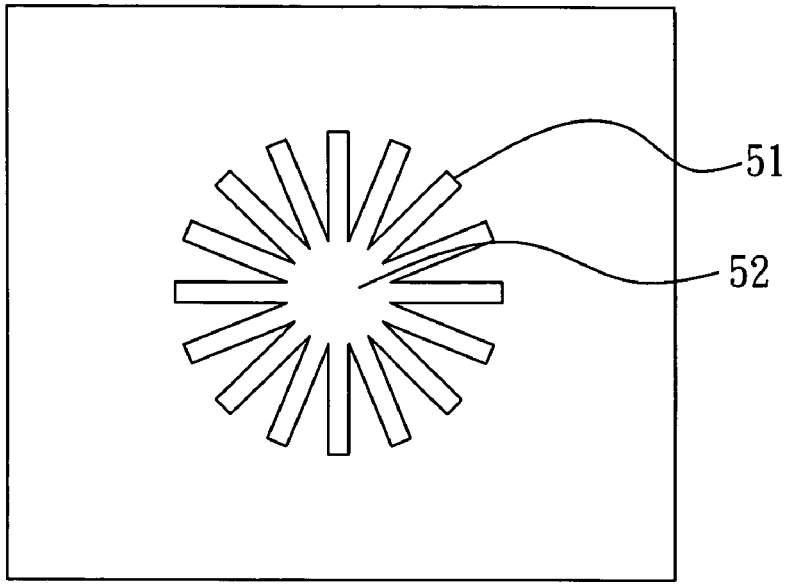
FIG. 5A is a schematic diagram of the upper surface of substrate of the circularly polarized antenna according to the second preferred embodiment of the present invention, wherein the quantity of the slots is 16.
Figure 5B:
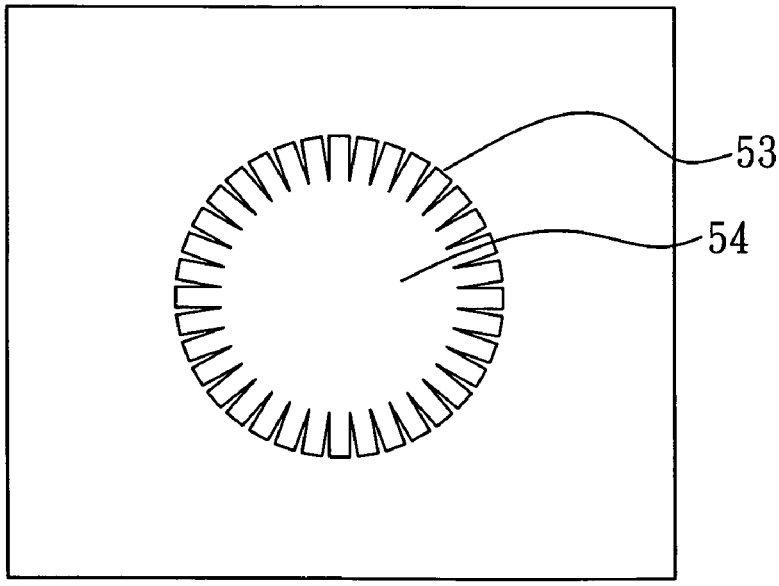
FIG. 5B is a schematic diagram of the upper surface of substrate of the circularly polarized antenna according to the third preferred embodiment of the present invention, wherein the quantity of the slots is 36.

FIG. 5A is a schematic diagram of the upper surface of substrate of the circularly polarized antenna according to the second preferred embodiment of the present invention, wherein there are 16 slots 51 formed on the upper surface of the substrate thereof. One end of each slot overlaps with the respective ends of the other slots at a central region 52. FIG. 5B is a schematic diagram of the upper surface of substrate of the circularly polarized antenna according to the third preferred embodiment of the present invention, wherein there are 36 slots 53 formed on the upper surface of the substrate thereof. One end of each slot 53 overlaps with respective ends of the other slots at a central region 54. By comparing FIG. 5A with 5B, it is shown that as the quantity of the slots is raised (from 16 to 36), and the area of the center region has become larger. In addition, the characteristics of the circularly polarized antenna of the present invention, such as the return loss, and the characteristics of the circularly polarized signal being transmitted by the circularly polarized antenna of the present invention will be affected by the different quantities of the slots formed on the upper surface of the substrate, as described below.

Figure 6A:
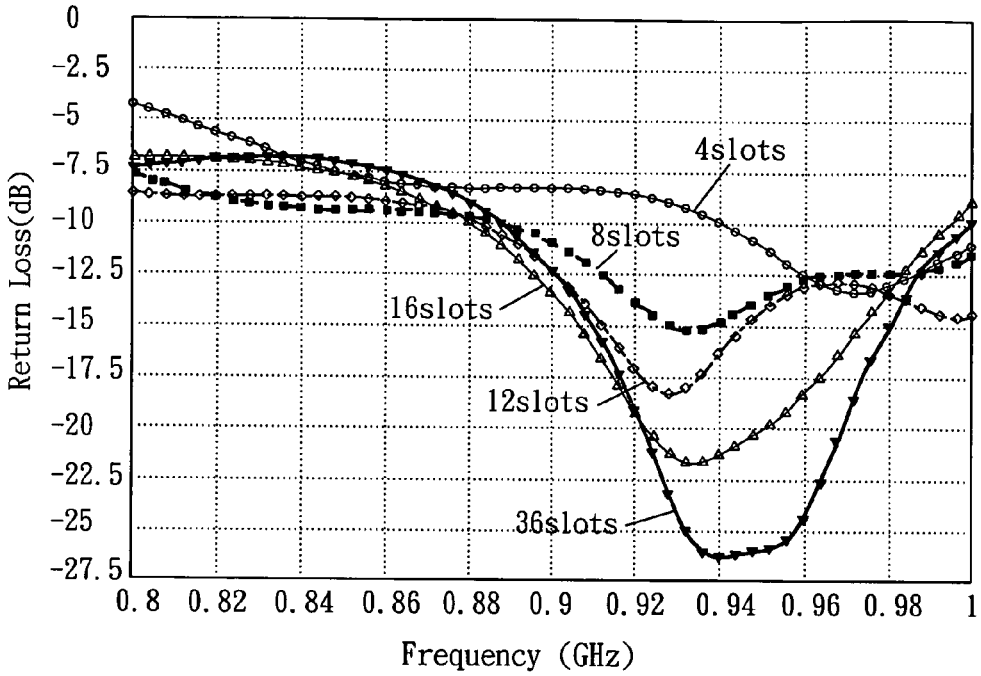
FIG. 6A shows the variation of the return loss of the circularly polarized antenna of the present invention regarding the changing of the operating frequency.
Figure 6B:
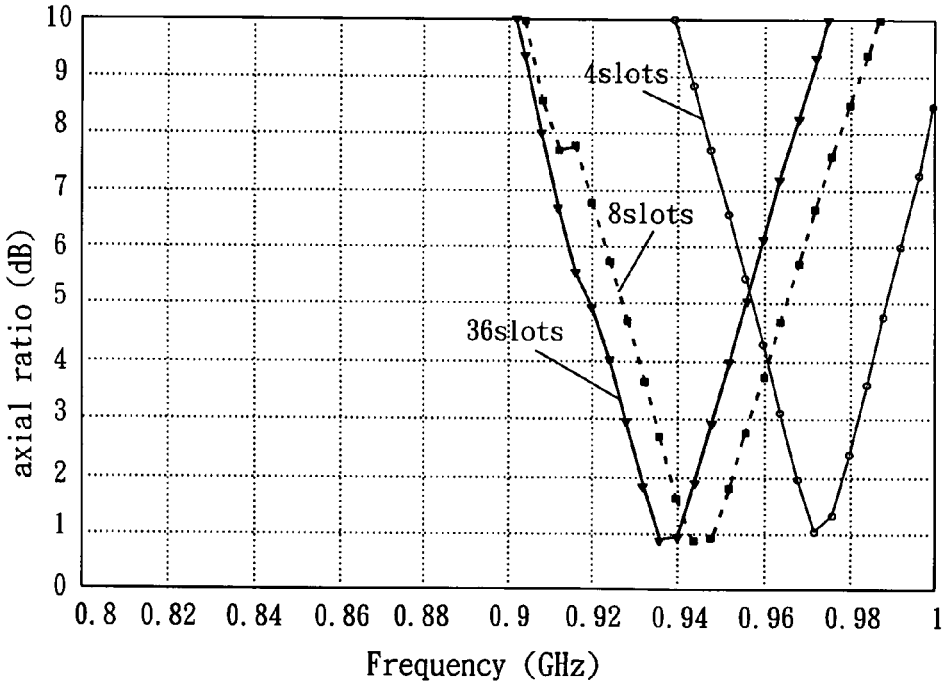
FIG. 6B shows the variation of the axial ratio of the circularly polarized antenna of the present invention regarding the changing of the operating frequency.

FIG. 6A shows the variation of the return loss of the circularly polarized antenna of the present invention regarding the changing of the operating frequency, wherein the upper surface of the substrate comprises different quantities of slots (4, 8, 12, 16 and 36). FIG. 6B shows the variation of the axial ratio of the circularly polarized antenna of the present invention regarding the changing of the operating frequency, wherein the upper surface of the substrate comprises different quantities of slots (4, 8, and 36).

As shown in FIG. 6A, when the quantity of the slots is raised, the return loss of the circularly polarized antenna of the present invention becomes smaller. That is, the circularly polarized antenna of the present invention can transform the electrical signal into the circularly polarized signal more efficiently. As shown in FIG. 6B, the signals transmitted by the circularly polarized antenna of the circularly polarized antenna are all circularly polarized, regardless of the quantity of the slots formed on the upper surface of the substrate thereof. Therefore, once the quantity of the slots is more than 8, the circularly polarized antenna of the present invention can have enough efficiency to transmit or receive the circularly polarized signals, without the need of forming too many slots on the upper surface of the substrate of the circularly polarized antenna of the present invention.

Figure 7:
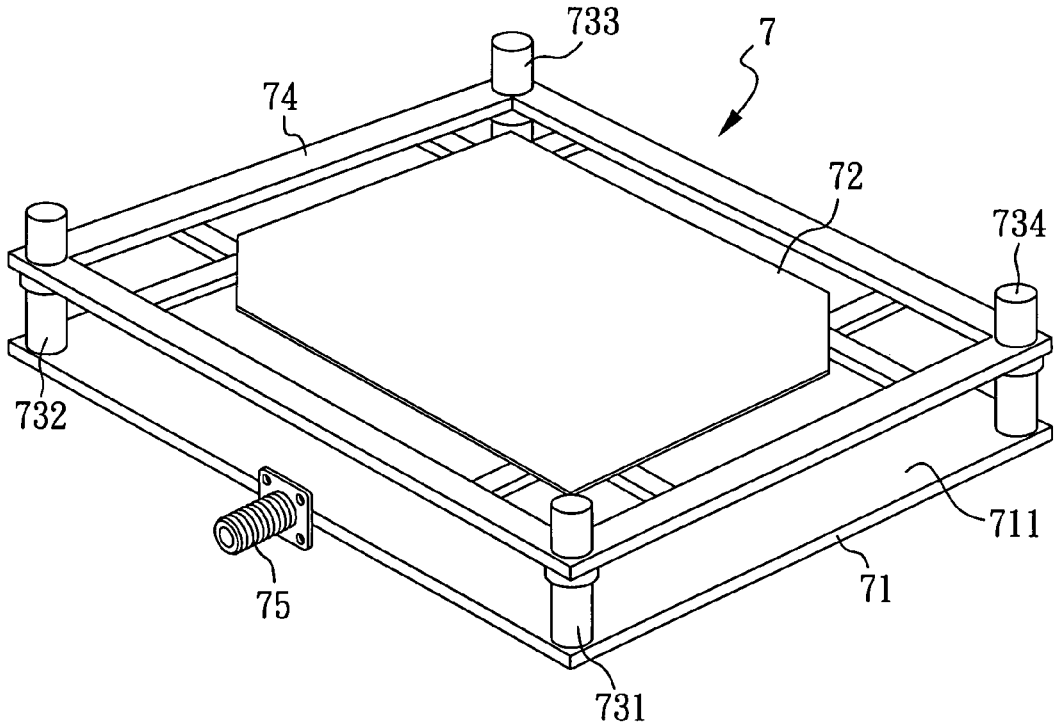
FIG. 7 is a schematic drawing of the circularly polarized antenna according to the fourth preferred embodiment of the present invention.

FIG. 7 is a schematic drawing of the circularly polarized antenna according to the fourth preferred embodiment of the present invention. In this preferred embodiment, the substrate 71 is an FR-4 microwave substrate with the thickness of 0.8 mm, and having a coaxial cable connector 75 mounting at the edge. The antenna 72 is composed of a copper alloy containing more than ninety-eight percent copper, and two of the corresponding corners are chamfered. As shown in FIG. 7, the antenna 71 connects with a supporting structure 74 which is supported by a first supporting rod 731, a second supporting rod 732, a third supporting 733, and a fourth supporting rod 734. Therefore, the antenna 72 maintains a predetermined between it and the upper surface 711 of the substrate 71. By adjusting the predetermined distance, the gain of the circularly polarized antenna of the present invention can be raised and the circularly polarized characteristics of the circularly polarized antenna can also be improved.

Since the predetermined distance between the antenna 72 and the upper surface 711 of the substrate 71 is essential for designing the operating frequency of the circularly polarized antenna 7, while the circularly polarized antenna 7 is required to change its operating frequency, the first supporting rod 731, the second supporting rod 732, the third supporting 733, and the fourth supporting rod 734 must be adjusted to change the predetermined distance between the antenna 72 and the upper surface 711 of the substrate 21. Besides, in the present embodiment, the slots formed on the upper surface of the substrate of the circularly polarized antenna can have any kind of shape. Moreover, after the "end treatment" is executed on the ends, the ends of the slots formed on the upper surface of the substrate of the circularly polarized antenna can have any kind of shape, as shown in FIG. 8A and FIG. 8B.

Figure 8A:
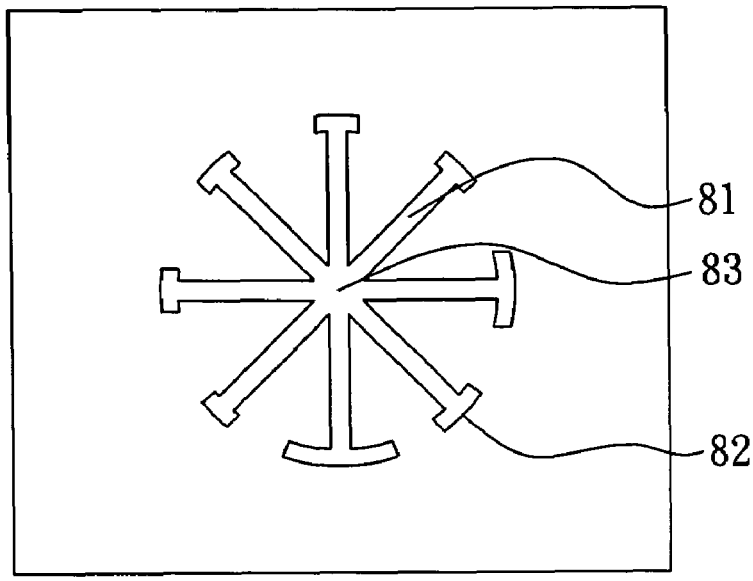
FIG. 8A is a schematic diagram of the upper surface of substrate of the circularly polarized antenna according to the fourth preferred embodiment of the present invention.
Figure 8B:
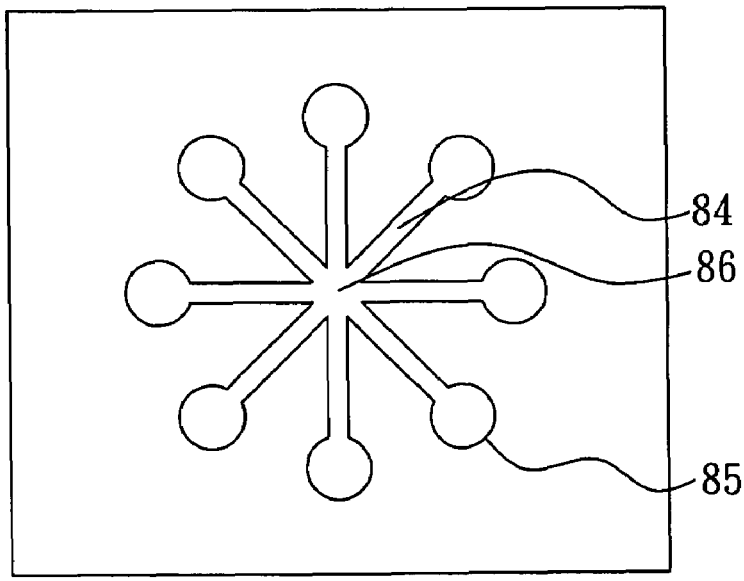
FIG. 8B is a schematic diagram of the upper surface of substrate of the circularly polarized antenna according to the fourth preferred embodiment of the present invention.

FIG. 8A is a schematic diagram of the upper surface of substrate of the circularly polarized antenna according to the fourth preferred embodiment of the present invention, wherein each slot 81 has a lateral slot 82 at one end, and the opposing end of each slot 81 overlaps with the respective ends of the other slots at a central region 83. FIG. 8B is a schematic diagram of the upper surface of substrate of the circularly polarized antenna according to the fourth preferred embodiment of the present invention, wherein each slot 81 has a dumbbell-shaped part 85 at one end, and the opposing end of each slot 84 overlaps with the respective ends of the other slots at a central region 86. In addition, the characteristics of the circularly polarized antenna of the present invention, such as the return loss, and the characteristics of the circularly polarized signal being transmitted by the circularly polarized antenna of the present invention will be affected by the different shape of the ends of the slots formed on the upper surface of the substrate, as described below.

Figure 9:
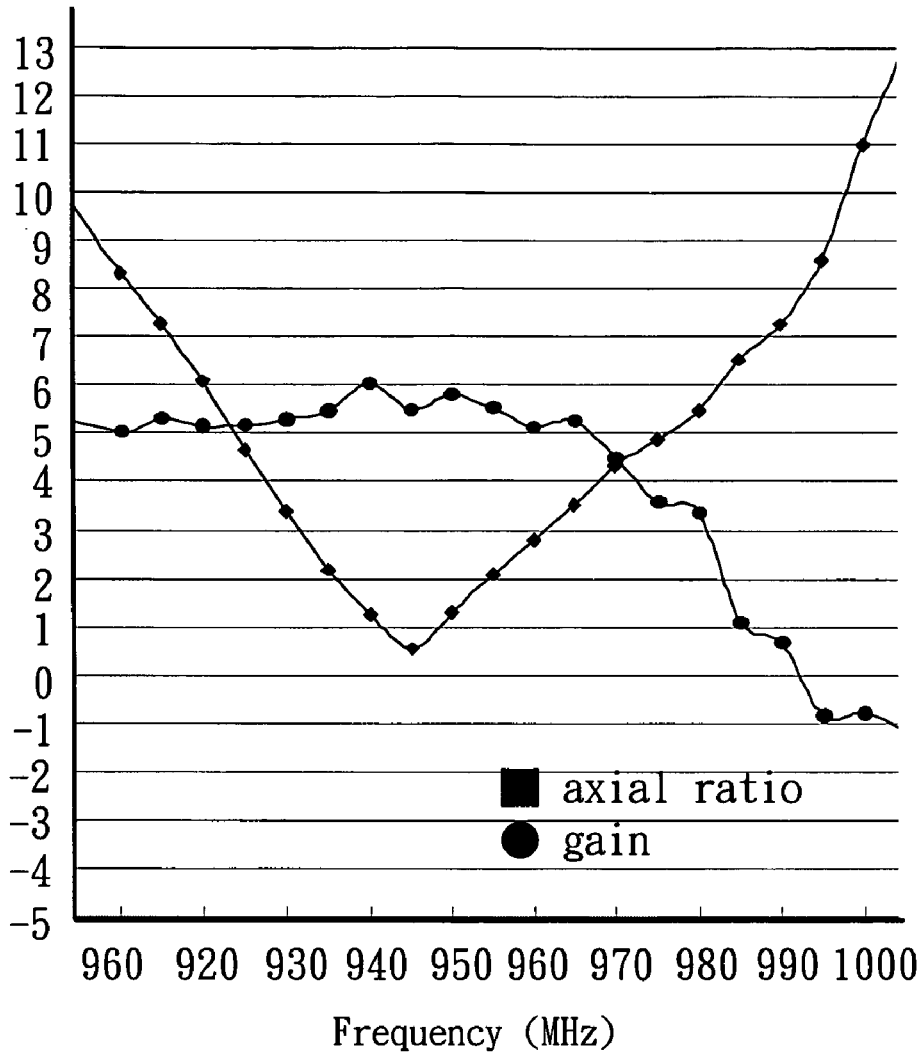
FIG. 9 shows the variation of the axial ratio of the circularly polarized signal and the gain of the circularly polarized antenna regarding the changing of the operating frequency.

FIG. 9 shows the variation of the axial ratio of the circularly polarized signal and the gain of the circularly polarized antenna regarding the changing of the operating frequency, wherein the curve connecting the square points is the axial ratio curve and the curve connecting the circle points is the gain curve.

Referring still to FIG. 9, in the present preferred embodiment, the center frequency of the circularly polarized signal is slightly higher than the operating frequency of an RFID system. Besides, the 3-dB bandwidth of the axial ratio of the circular polarized signal transmitted by the circularly polarized antenna according to the fourth preferred embodiment is wider than the 3-dB bandwidth of the axial ratio of the circular polarized signal transmitted by the circularly polarized antenna according to the first preferred embodiment. In addition, the gain of the circularly polarized antenna according to the fourth embodiment in the operating frequency range of an RFID system is always larger than 4 dB. Therefore, the circularly polarized antenna according to the fourth preferred embodiment of the present invention can be used in most of the applications of the circularly polarized antenna.

In summary, in the same range of the operating frequency (i.e. the operating frequency of the RFID ranges from 902 MHz to 928 MHz), the circularly polarized antenna of the present invention can reduce the size of the antenna and the substrate by forming some slots on the upper and lower surface of the substrate and by changing the size of the coupling portion, so as to maintain the same operating ability as the circularly polarized antenna of the prior art (i.e. having the same return loss and the operating frequency bandwidth). Therefore, the circularly polarized antenna of the present invention can have a compact size and keep antenna as simple, so as to facilitate the development of a small-sized, more convenient and portable electrical device having the circularly polarized antenna of the present invention, such as the reader device of an RFID system.

Although the present invention has been explained in relation to its preferred embodiment, it is to be understood that many other possible modifications and variations can be made without departing from the scope of the invention as hereinafter claimed.

What is claimed is:

1. A circularly polarized antenna for transmitting and receiving a circularly polarized signal, comprising:

a substrate having an upper surface and a lower surface;

a signal distributor;

an antenna for transmitting and receiving the circularly polarized signal; and a plurality of support units for supporting the antenna and maintaining a predetermined distance between the antenna and the upper surface of the substrate;

wherein the upper surface of the substrate comprises more than four slots, one end of each slot overlapping with the respective ends of the other slots at a central region and all of the slots have the same length; the lower surface of the substrate comprising a coupling unit being electrically connected with the signal distributor, and the center of the coupling unit corresponds to the central region.

2. The circularly polarized antenna as claimed in claim 1, wherein the coupling unit comprises a coupling portion and a connecting portion, the connecting portion being electrically connected with the signal distributor and the coupling portion.

3. The circularly polarized antenna as claimed in claim 2, wherein the coupling portion is a coupling-ring portion with an opening.

4. The circularly polarized antenna as claimed in claim 1, wherein the substrate is an FR-4 microwave substrate.

5. The circularly polarized antenna as claimed in claim 1, wherein the signal distributor is a coaxial cable connector.

6. The circularly polarized antenna as claimed in claim 1, wherein the signal distributor is electrically connected with a coaxial cable.

7. The circularly polarized antenna as claimed in claim 1, wherein each of the slots has the same width.

8. The circularly polarized antenna as claimed in claim 1, wherein the width of each of the slots is equal to the width of the coupling portion.

9. The circularly polarized antenna as claimed in claim 1, wherein each slots has a dumbbell-shaped end.

10. The circularly polarized antenna as claimed in claim 1, wherein the antenna is a copper plate.

11. The circularly polarized antenna as claimed in claim 1, wherein the substrate is a square-shaped plate.

12. The circularly polarized antenna as claimed in claim 1, wherein the antenna is a square-shaped plate.

13. The circularly polarized antenna as claimed in claim 1, wherein the antenna is a square-shaped plate with at least one corner being chamfered.

14. The circularly polarized antenna as claimed in claim 1, wherein the antenna is a polygon-shaped plate.

15. The circularly polarized antenna as claimed in claim 1, wherein the support unit is composed of an electrically insulating material.

16. The circularly polarized antenna as claimed in claim 1, wherein the frequency of the circularly polarized signal ranges from 900 MHz to 930 MHz.

17. The circularly polarized antenna as claimed in claim 1, wherein the frequency of the circularly polarized signal ranges from 400 MHz to 600 MHz.

18. The circularly polarized antenna as claimed in claim 1, wherein a side-length of the antenna ranges from the one-quarter to three-quarters of the wavelength of the circularly polarized signal.

19. The circularly polarized antenna as claimed in claim 1, wherein the predetermined distance between the antenna and the upper surface of the substrate is changed by adjusting the length of the supporting units.

* * * * *